US009156245B2

(12) United States Patent
Eitel et al.

(10) Patent No.: US 9,156,245 B2
(45) Date of Patent: Oct. 13, 2015

(54) INSPECTION SYSTEM FOR INSPECTING THE QUALITY OF PRINTED SHEETS

(75) Inventors: Johann Emil Eitel, Thüngen (DE); Axel Siemer, Hettstadt (DE); Johannes Georg Schaede, Würzburg (DE)

(73) Assignee: KBA-NOTASYS SA, Lausanne (CH)

( * ) Notice: Subject to any disclaimer, the term of this patent is extended or adjusted under 35 U.S.C. 154(b) by 693 days.

(21) Appl. No.: 12/997,057

(22) PCT Filed: Jun. 19, 2009

(86) PCT No.: PCT/IB2009/052639

§ 371 (c)(1),
(2), (4) Date: Jun. 6, 2011

(87) PCT Pub. No.: WO2009/156926

PCT Pub. Date: Dec. 30, 2009

(65) Prior Publication Data

US 2011/0250001 A1 Oct. 13, 2011

(30) Foreign Application Priority Data

Jun. 27, 2008 (EP) ..... 08159288

(51) Int. Cl.
*B41F 13/24* (2006.01)
*B41F 33/00* (2006.01)
*B65H 29/04* (2006.01)

(52) U.S. Cl.
CPC ..... *B41F 33/0036* (2013.01); *B65H 29/041* (2013.01); *B65H 2406/111* (2013.01);
(Continued)

(58) Field of Classification Search
CPC ..... B65H 2406/362
USPC ..... 101/232
See application file for complete search history.

(56) References Cited

U.S. PATENT DOCUMENTS 4,225,129 A * 9/1980 Zimmermann et al. ..... 271/204
5,259,608 A * 11/1993 Pollich ..... 271/183

(Continued)

FOREIGN PATENT DOCUMENTS

DE 4436583 4/1996
DE 9422086 1/1998

(Continued)

*Primary Examiner* — Anthony Nguyen
(74) *Attorney, Agent, or Firm* — Seager, Tufte & Wickhem LLP

(57) ABSTRACT

There is described an inspection system (10) for inspecting the quality of printed sheets which are transported by a sheet conveyor system comprising at least one sheet gripper system (3*a*, 3*b*) including a plurality of spaced-apart gripper bars (32) for holding the printed sheets by a leading edge thereof. The inspection system (10) comprises an optical quality control apparatus for carrying out inspection of a first side of the printed sheets while the printed sheets are being transported by the sheet gripper system (3*b*). The optical quality control apparatus includes a line camera (11) for scanning the first side of the printed sheets at an inspection location which is situated at a location proximate to a portion of the sheet gripper system (3*b*) where the gripper bars (32) transporting the printed sheets undergo a change of direction of displacement while the printed sheets are still being scanned by the line camera (11). The inspection system (10) further comprises a suction roller (50) that is placed in front of the optical path (B) of the line camera (11) along the path (A) of the printed sheets being transported by the sheet gripper system (3*b*), which suction roller (50) contacts a second side of the printed sheets opposite to the first side which is being scanned by the line camera (11), the suction roller (50) being driven at a selected circumferential speed to drive successive portions of the printed sheets being inspected by the quality control apparatus at a determined and controlled speed past the line camera (11).

20 Claims, 12 Drawing Sheets

(52) U.S. Cl.
CPC ..... *B65H2406/112* (2013.01); *B65H 2406/13* (2013.01); *B65H 2406/31* (2013.01); *B65H 2406/33* (2013.01); *B65H 2406/362* (2013.01); *B65H 2553/42* (2013.01); *B65H 2801/21* (2013.01)

(56) References Cited

U.S. PATENT DOCUMENTS

| | | | | |
|---|---|---|---|---|
| 5,329,852 | A | 7/1994 | Bolza-Schuenemann et al. | |
| 5,368,148 | A | 11/1994 | Orlandini | |
| RE35,495 | E | 4/1997 | Bolza-Schuenemann et al. | |
| 5,797,321 | A | 8/1998 | Shibata | |
| 5,974,683 | A | 11/1999 | Shibata | |
| 6,000,695 | A * | 12/1999 | Mack et al. | 271/303 |
| 6,109,172 | A | 8/2000 | Wyssmann | |
| 6,111,261 | A | 8/2000 | Bolza-Schunemann et al. | |
| 6,176,482 | B1 | 1/2001 | Reinhard et al. | |
| 6,192,140 | B1 | 2/2001 | Reinhard et al. | |
| 6,302,016 | B1 | 10/2001 | Fausto et al. | |
| 6,539,863 | B2 | 4/2003 | Shiraishi | |
| 6,571,709 | B1 * | 6/2003 | Marincic et al. | 101/477 |
| 6,684,780 | B2 | 2/2004 | Shiraishi | |
| 6,715,945 | B2 * | 4/2004 | Yamamoto et al. | 400/120.09 |
| 6,746,014 | B2 | 6/2004 | Endo et al. | |
| 6,772,689 | B2 | 8/2004 | Endo et al. | |
| 6,877,427 | B2 | 4/2005 | Dunninger et al. | |
| 6,883,429 | B2 * | 4/2005 | Kamoda | 101/480 |
| 7,715,071 | B2 * | 5/2010 | Takeda et al. | 358/518 |
| 8,328,194 | B2 * | 12/2012 | Reinhard et al. | 271/275 |
| 2001/0020427 | A1 | 9/2001 | Shiraishi | |
| 2001/0027730 | A1 * | 10/2001 | Kamoda | 101/190 |
| 2002/0035939 | A1 | 3/2002 | Endo et al. | |
| 2002/0108516 | A1 | 8/2002 | Endo et al. | |
| 2003/0107609 | A1 | 6/2003 | Shiraishi | |
| 2004/0163557 | A1 * | 8/2004 | Kobayashi et al. | 101/232 |
| 2004/0173113 | A1 | 9/2004 | Dunninger et al. | |
| 2005/0127595 | A1 | 6/2005 | Hendle et al. | |
| 2006/0042487 | A1 * | 3/2006 | Beitel et al. | 101/232 |
| 2006/0219107 | A1 | 10/2006 | Gygi | |
| 2006/0261120 | A1 * | 11/2006 | Slyne | 226/95 |
| 2007/0222206 | A1 | 9/2007 | Schaede et al. | |
| 2007/0262512 | A1 * | 11/2007 | Watanabe et al. | 271/11 |
| 2008/0233354 | A1 * | 9/2008 | Anderson et al. | 428/165 |
| 2008/0295724 | A1 | 12/2008 | Lohweg et al. | |
| 2009/0096156 | A1 | 4/2009 | Hendle et al. | |
| 2010/0170408 | A1 | 7/2010 | Gygi et al. | |

FOREIGN PATENT DOCUMENTS

| | | |
|---|---|---|
| EP | 0527453 | 2/1993 |
| EP | 0559616 | 9/1993 |
| EP | 0820864 | 1/1998 |
| EP | 0820865 | 1/1998 |
| EP | 0985548 | 3/2000 |
| EP | 1136266 | 9/2001 |
| EP | 1190855 | 3/2002 |
| EP | 1231057 | 8/2002 |
| EP | 1777184 | 4/2007 |
| EP | 1961559 | 8/2008 |
| JP | 5-254091 | 10/1993 |
| WO | 97/34767 | 9/1997 |
| WO | 97/36813 | 10/1997 |
| WO | 97/37329 | 10/1997 |
| WO | 97/48556 | 12/1997 |
| WO | 02/102595 | 12/2002 |
| WO | 03/070465 | 8/2003 |
| WO | 2005/000585 | 1/2005 |
| WO | 2005/102728 | 11/2005 |
| WO | 2007/060615 | 5/2007 |
| WO | 2008/102303 | 8/2008 |

* cited by examiner

INSPECTION SYSTEM FOR INSPECTING THE QUALITY OF PRINTED SHEETS

TECHNICAL FIELD

The present invention generally relates to an inspection system for inspecting the quality of printed sheets which are transported by a sheet conveyor system comprising at least one sheet gripper system including a plurality of spaced-apart gripper bars for holding the printed sheets by a leading edge thereof, the inspection system comprising an optical quality control apparatus for carrying out inspection of a first side of the printed sheets while the printed sheets are being transported by the sheet gripper system.

BACKGROUND OF THE INVENTION

Such inspection systems are known as such in the art, for instance from European patent application Nos. EP 0 527 453 A1, EP 0 559 616 A1 and U.S. Pat. No. 5,329,852 and U.S. Re 35,495. According to these known solutions, one side of the printed sheets to be inspected is drawn by aspiration against a substantially flat surface of a stationary suction box, while the other side is captured by a suitable optical quality control apparatus, including either a line camera for scanning the surface of the sheets during transport thereof by the sheet gripper system or an array camera for taking a snapshot of the surface of the sheets.

Similar solutions are disclosed in European patent applications Nos. EP 0 820 864 A1, EP 0 820 865 A1, EP 1 190 855 A1 and EP 1 231 057 A1, which all make use of a stationary suction box or table having a substantially flat surface for aspirating the sheets during the inspection process.

EP 1 190 855 A1, which corresponds to U.S. Pat. No. 6,772,689 B2, discloses an inspection system wherein a suction roller is further located upstream of the stationary suction table with respect to the direction of displacement of the sheets. This suction roller is driven by a separate drive at a circumferential speed that is lower than the displacement speed of the sheets in order to decelerate, or more exactly pull the sheets before they are aspirated against the surface of the suction table and inspected by the array camera.

Other solutions are known for instance from International applications Nos. WO 97/36813 A1, WO 97/37329 A1 and WO 03/070465 A1. According to these other solutions, the printed sheets are inspected using an array camera while the sheets are drawn by aspiration against a curved surface. Such an inspection device making use of an array camera may be disposed at different locations along the path of a sheet gripper system of a printing or processing press depending on the sheet delivery configuration, as for instance illustrated in European patent application Nos. EP 0 985 548 A1, EP 1 777 184 A1 and International application Nos. WO 2005/102728 A1, WO 2007/060615 A1.

Another solution is disclosed in International application No. WO 02/102595 A1 which makes use of a moveable band running above the surface of a suction box.

The above described known inspection systems are satisfying as long as the sheets are being transported by the sheet gripper system along a well-defined path.

Inspection by means of an array camera requires a substantial amount of space as each sheet to be inspected has to be drawn against a reference surface having dimensions corresponding to those of the sheet during the image acquisition process so that the array camera can take a snapshot of the whole surface of the sheet to be inspected.

On the other hand, inspection by means of a line camera requires less space as the image acquisition process involves scanning successive portions of each sheet to be inspected, which successive portions are combined together to build the image of the whole surface of the sheet to be inspected. This process accordingly involves a relative displacement of the sheets with respect to the line camera, which relative displacement is achieved as a result of the transportation of the sheets past the camera by means of the sheet gripper system.

Due to the fact that inspection by means of a line camera involves a relative displacement of the sheets with respect to the line camera, care should be taken that the sheet is being conveyed in a stable way in front of the line camera throughout the image acquisition process. This can be achieved quite easily as long as the sheets are being transported along a rectilinear path past the line camera up to the trailing edge of the sheets. This typically involves a relatively long and flat sheet conveying path downstream of the line camera, the length of which must at least be equal to the length of the sheets to be inspected.

Such a relatively long and flat sheet conveying path downstream of the line camera is however not available in all printing presses making use of a sheet gripper system for the delivery of printed sheets, which fact is problematic. Indeed, a change in the direction of displacement of the gripper bars holding the leading edge of the sheets before the end of the image acquisition process has the effect of creating undulations along the length of the transported sheets, which undulations prevent the sheets from being properly aspirated against a reference surface and negatively affect the inspection process as the undulations create ripples that become visible on the acquired images and cause inspection errors.

There is therefore a need for an improved inspection system making use of a line camera for inspecting the quality of printed sheets which are transported by a sheet conveyor system comprising at least one sheet gripper system.

SUMMARY OF THE INVENTION

A general aim of the invention is thus to improve the known inspection systems wherein a line camera is used to scan the surface of printed sheets that are being transported by a sheet conveyor system comprising at least one sheet gripper system with spaced-apart gripper bars.

Another aim of the invention is to ensure a proper and stable support of the sheets throughout the image acquisition process.

Still another aim of the invention is to provide an inspection system that is adapted to carry out inspection by means of a line camera of a first side of printed sheets in a machine environment wherein the line camera is situated at a location proximate to a portion of the sheet gripper system where the gripper bars that are holding the printed sheets by their leading edge undergo a change of direction of displacement while the printed sheets are still being scanned by the line camera.

These aims are achieved thanks to the solution defined in the claims.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

DETAILED DESCRIPTION OF EMBODIMENTS OF THE INVENTION

The invention will be described hereinafter in the context of a sheet-fed screen printing press for printing security papers, in particular banknotes, as illustrated schematically in FIG. 1. The invention is however equally applicable to any type of printing or processing press wherein sheets are transported by a sheet conveyor system comprising at least one sheet gripper system including a plurality of spaced-apart gripper bars.

Figure 1:
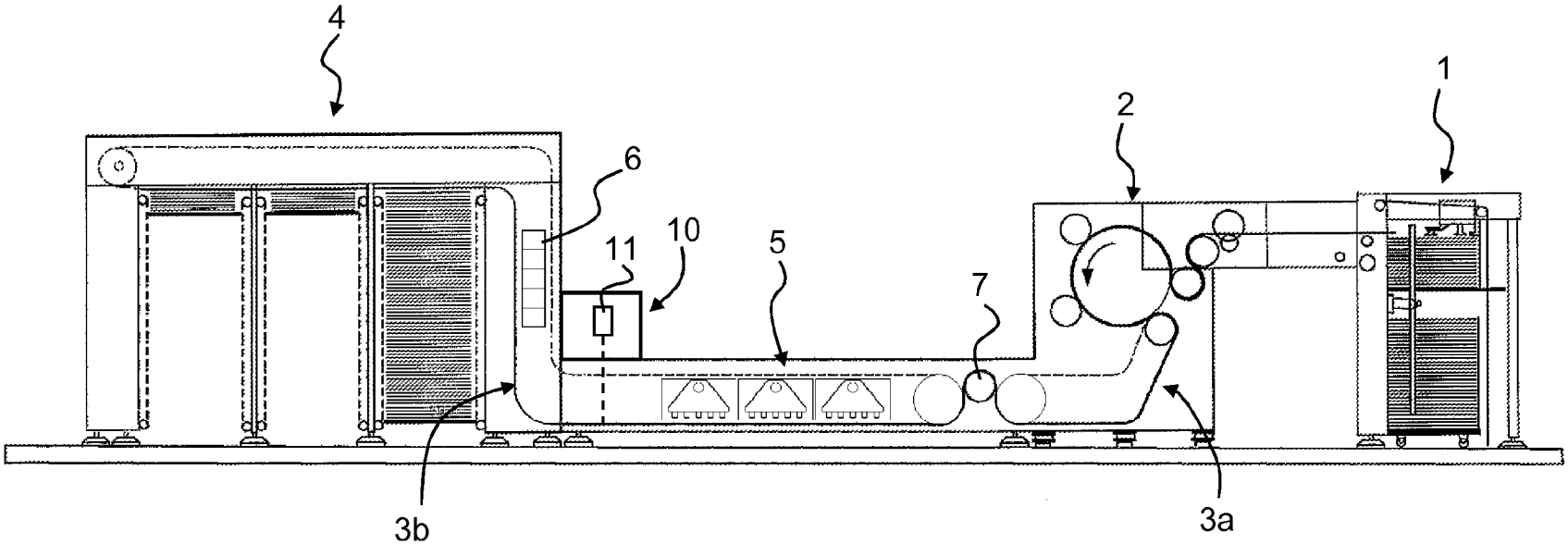
FIG. 1 is a schematic side view of a printing press, namely a screen printing press, comprising an inspection system according to the invention.

As illustrated in FIG. 1, the screen printing press comprises a feeding station 1 for feeding successive sheets to a printing group 2 where ink patterns are applied onto the sheets. In this example, the printing group 2 is designed for screen printing and comprises an impression cylinder cooperating with first and second screen printing units placed in succession along the printing path of the sheets. The general configuration of the screen printing group 2 is similar to that described in International application WO 97/34767 A1 in the name of the present Applicant which is incorporated herein by reference.

Once processed in the printing group 2, the freshly printed sheets are transported by means of a sheet conveyor system 3*a*, 3*b* to a delivery unit 4 comprising a plurality of delivery pile units, three in this example. The sheet conveyor system 3*a*, 3*b* comprises a plurality of spaced-apart gripper bars (not shown in FIG. 1) extending transversely to the sheet transporting direction, each gripper bar comprising grippers for holding a leading edge of the sheets. In this example, the sheet conveyor system 3*a*, 3*b* runs downwards from the printing unit 2 to a floor portion of the printing press and then from the floor portion upwards to an upper part of the delivery unit 4.

In the example shown in FIG. 1, the sheet conveyor system 3*a*, 3*b* comprises two sheet gripper systems 3*a* and 3*b*. The first sheet gripper system 3*a* transports the sheets from the impression cylinder of the printing group 2 to a processing cylinder 7. The second sheet gripper system 3*b* transports the sheets from the processing cylinder 7 to the delivery unit 4. It shall however be appreciated that the sheet conveyor system may comprise only one sheet gripper system (as illustrated in International application WO 97/34767 A1) or of any number of sheet gripper systems cooperating with one another.

As this can be appreciated in FIG. 1, the sheet gripper systems 3*a* and 3*b* each comprise lower and upper gripper paths along which the gripper bars (not shown in FIG. 1) are led, the printed sheets being transported by the sheet gripper systems 3*a* and 3*b* on the lower gripper path with the printed side (the "first side") oriented upwards.

The processing cylinder 7 is advantageously a magnetic cylinder for orienting magnetically-orientable pigments or flakes contained in at least one ink or varnish vehicle applied on the sheets in the printing group 2. Such a magnetic cylinder forms the subject-matter of International application No. WO 2005/000585 A1 in the name of the present Applicant which is incorporated herein by reference. A particularly advantageous configuration of such a magnetic cylinder also forms the subject-matter of European patent application No. 07102749.4 in the name of the present Applicant, filed on Feb. 20, 2007 and entitled "CYLINDER BODY FOR ORIENTING MAGNETIC FLAKES CONTAINED IN AN INK OR VARNISH VEHICLE PRINTED ON A SHEET-LIKE OR WEB-LIKE SUBSTRATE" (which is published as EP 1 961 559 A1), and of the corresponding International application No. PCT/IB2008/050592 filed on Feb. 19, 2008 and claiming priority from European patent application No. 07102749.4 (which is published as WO 2008/102303 A2/A3), both of which are incorporated herein by reference.

Drying units 5, 6 are preferably further located along the path of the sheet conveyor system between the processing cylinder 7 and the delivery unit 4. These drying units 5, 6 are used to perform final drying and curing of the screen-printed ink patterns. Drying unit 5 is preferably a thermal drying unit (or hot-air dryer) for applying thermal energy to the sheets, while drying unit 6 is preferably a UV dryer for subjecting the sheets to UV radiation. The combination of drying units 5, 6 ensures adequate drying and curing of the applied ink patterns and assures that the brilliance and optically variable effect of the screen-printed features are maximized and prolonged. One or both of the drying systems 5, 6 can be installed on the machine depending on the production requirements and the type of inks used.

According to the present invention, an inspection system 10 is located along the path of the sheet conveyor system, or more precisely, along the path of the second sheet gripper system 3*b*, between the drying systems 5 and 6. This inspection system 10 comprises an optical quality control apparatus for carrying out inspection of a first side of the printed sheets while the printed sheets are being transported by the sheet gripper system 3*b*. More precisely, the optical quality control apparatus includes a line camera 11 for scanning the first side of the printed sheets. In the example of FIG. 1, the line camera 11 is located above the lower gripper path of the sheet gripper system 3*b* and looks towards the upper side of the printed sheets being transported on the lower gripper path.

The line camera 11 is situated at a location proximate to a portion of the sheet gripper system 3*a* where the gripper bars transporting the printed sheets undergo a change of direction of displacement while the printed sheets are still being scanned by the line camera. More precisely, the optical quality control apparatus is located in the vicinity of the floor portion of the printing press, proximate to the location where the sheet conveyor system moves upwards from the floor portion to the upper part of the delivery unit 4.

Figure 2:
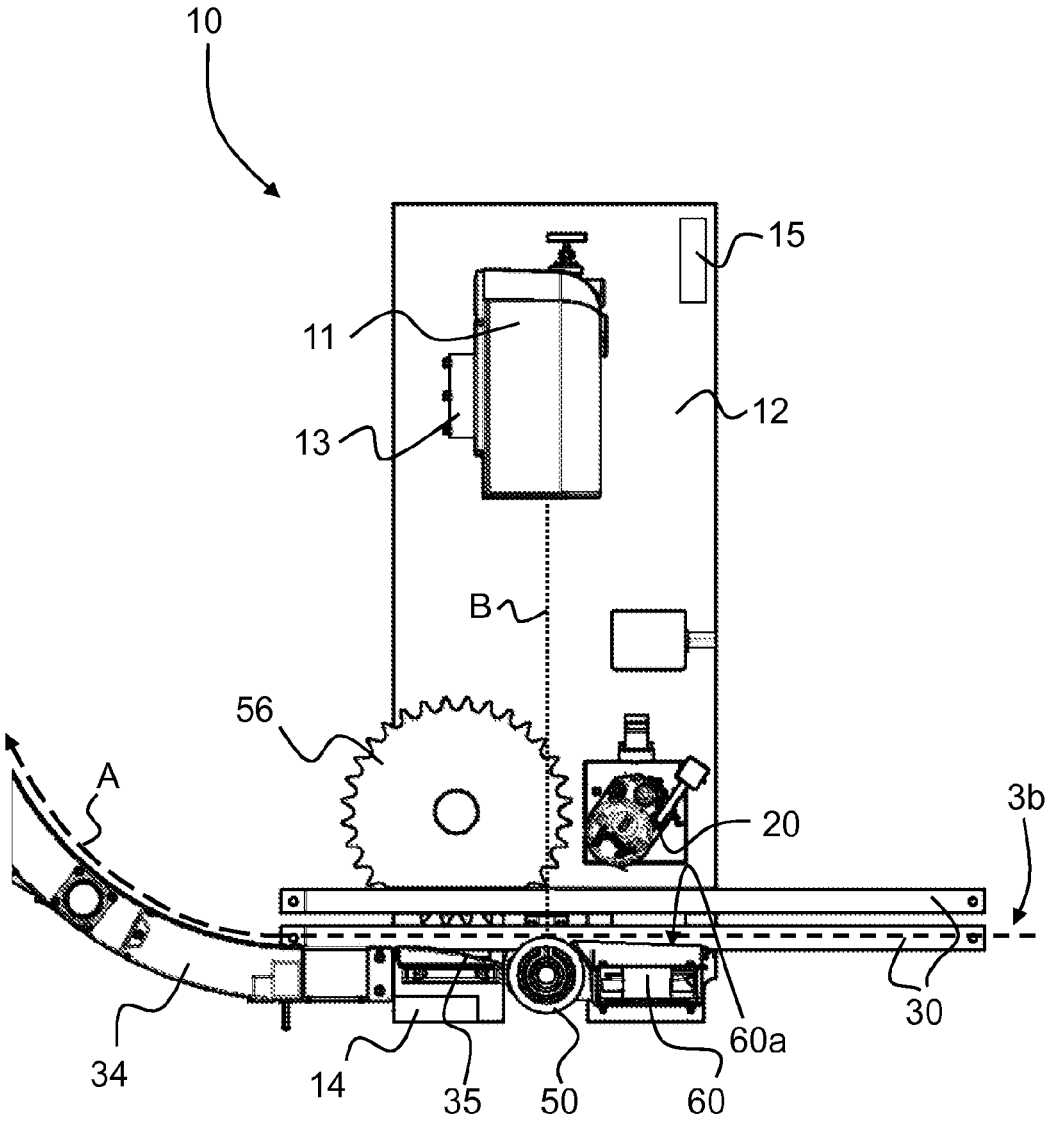
FIG. 2 is a schematic side view of the inspection system of FIG. 1 according to one embodiment of the invention.

FIG. 2 is a more detailed side view of the inspection system 10 of FIG. 1 according to one embodiment of the invention. As illustrated, the line camera 11 is located above the lower path of the sheet conveyor system, it being understood that the sheets are being conveyed along the path indicated by the dash line designated by reference A (i.e. from right to left in FIG. 2).

A pair of guiding rails 30 defining a guiding track for the endless chains (not shown) of the sheet gripper system is visible in FIG. 2. There is further shown a curved sheet guiding member 34 located below the path A of the sheets, which curved sheet guiding member 34 is designed to guide the sheets being transported along the curved path of the sheet conveyor system going upward towards the upper part of the delivery unit 4.

Also located above the path A of the sheets is an illumination unit 20 intended to illuminate a desired portion of the sheets being inspected by the line camera 11. This illumination unit 20 is disposed transversally to the direction of displacement of the sheets to uniformly illuminate the sheets along a width thereof.

As illustrated in FIG. 2, a suction roller 50 is located below the path A of the sheets in front of the optical path of the line camera 11 which is depicted by the dotted line B. This suction roller 50 is arranged to contact a second side of the printed sheets opposite to the first side which is being scanned by the line camera 11. This suction roller is preferably driven at a selected circumferential speed to drive successive portions of the printed sheets being inspected by the quality control apparatus at a determined and controlled speed past the line camera 11.

Downstream of the suction roller 50, there is provided an inclined sheet guiding ramp 35 leading up to the sheet guiding member 34. Air might be blown through apertures provided on the sheet guiding member 34 and/or sheet guiding ramp 35 to assist guidance of the sheets downstream of the inspection location.

Upstream of the suction roller 50, there is preferably provided a suction box 60 that is located immediately before the suction roller 50. This suction box 60 is designed to cooperate with the second side of the printed sheets being transported for aspirating at least a portion of this second side of the printed sheets against a substantially flat surface 60*a* before contacting the suction roller 50. The use of the suction box 60 is preferred in that it enables to properly draw the sheets to be inspected towards the downstream-located suction roller 50 and ensure that the sheets are then properly being supported against the circumference of the suction roller 50 during the image acquisition process.

The line camera 11 is mounted on a cross beam 13 between two side frames 12 located on either side of the path of the sheet conveyor system. Further cross beams 14 and 15 are provided between the side frames 12, transversely to the direction of displacement of the sheets.

Also visible in FIG. 2 is a single-turn shaft 56 (or "Eintourenwelle" in German) the purpose of which will now be explained in reference to FIG. 3. As illustrated in greater detail in FIG. 3, the single-turn shaft 56 is driven into rotation by the endless chains 31 of the sheet gripper system (each sheet gripper system comprises a pair of endless chains 31 located on either side of the gripper bars 32, one of the gripper bars 32 being partly visible in FIG. 3) and is designed to perform one complete revolution corresponding to the frequency of the passage of successive gripper bars 32.

In the preferred embodiment of the invention, the suction roller 50 is driven into rotation by the chains 31 driving the gripper bars 32 through a mechanical coupling between the suction roller 50 and the chains 31. This can for instance be achieved, as illustrated in FIG. 3, by making use of the single-turn shaft 56 to drive into rotation the suction roller 50. This can advantageously be performed by using the single-turn shaft 56 to drive into rotation an associated gear wheel 55 which is placed on the same rotation axis as the single-turn shaft 56, which gear wheel 55 in turn meshes with a second gear wheel 54 that drives into rotation a first pulley 53 of a driving belt arrangement 51-53. This first pulley 53 transmits its rotational movement to a second pulley 51 via a driving belt 52, the second pulley 51 being secured to one extremity of the suction roller 50.

Figure 3:
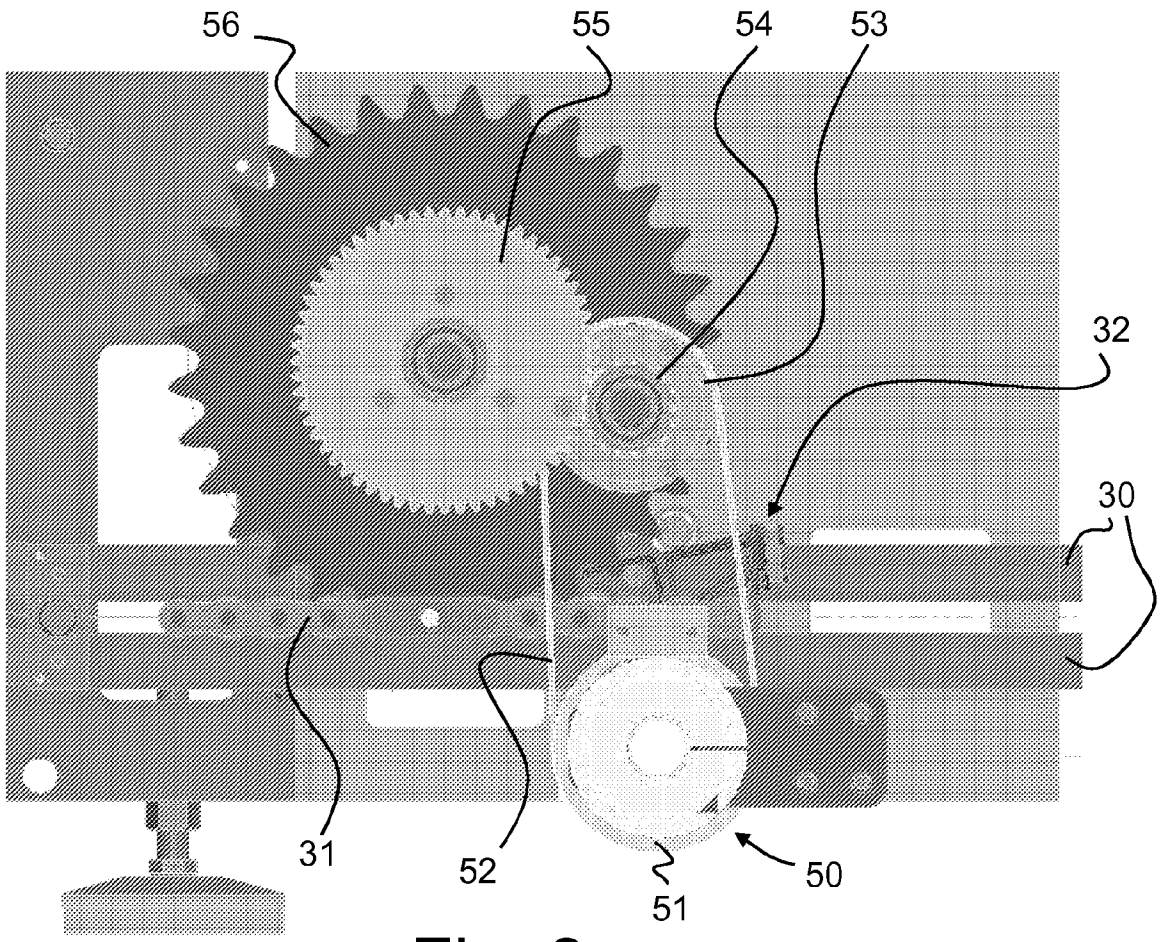
FIG. 3 is a schematic side view of a portion of the inspection system of FIG. 2 illustrating a mechanical coupling between the endless chains of a sheet gripper system and a suction roller of the inspection system.

In other words, the chains 31 of the sheet gripper system drive the single-turn shaft 56 into rotation (in the clockwise direction in FIG. 3), which causes the suction roller 50 to be correspondingly driven into rotation (in the counter-clockwise direction in FIG. 3).

The dimensions of the single-turn shaft 56, gear wheels 54, 55, pulleys 51, 53 and of the suction roller 50 are selected such that the suction roller 50 is driven at a selected circumferential speed to drive successive portions of the printed sheets being inspected by the quality control apparatus at a determined and controlled speed past the line camera 11.

In the example illustrated in FIG. 3, one will understand that rotation of the suction roller 50 is synchronized with the displacement of the gripper bars 32 and that the circumferential speed of the suction roller 50 thus corresponds to the displacement speed of the gripper bars 32.

In the illustrated example, the circumference of the suction roller 50 is smaller than the spacing between two successive gripper bars 32 of the sheet gripper system, the diameter of the suction roller 50 being limited by the available space between the lower path of the sheet gripper system and the floor onto which the printing press is supported. Preferably the circumference of the suction roller 50 is selected to be a fraction of the spacing between two successive gripper bars 32 of the sheet gripper system (in this case ⅓ of the spacing between two successive gripper bars 32, the suction roller 50 thus performing three revolutions during the passage of a sheet).

Other arrangements could be envisaged to appropriately drive the suction roller 50 into rotation. An alternate solution may for instance be to drive the suction roller 50 into rotation by means of a separate drive, such as a servo-motor. In such case, synchronism between the rotation of the suction roller 50 and the passage of the gripper bars 32 could be ensured by an appropriate electronic control of the separate drive.

Figure 4:
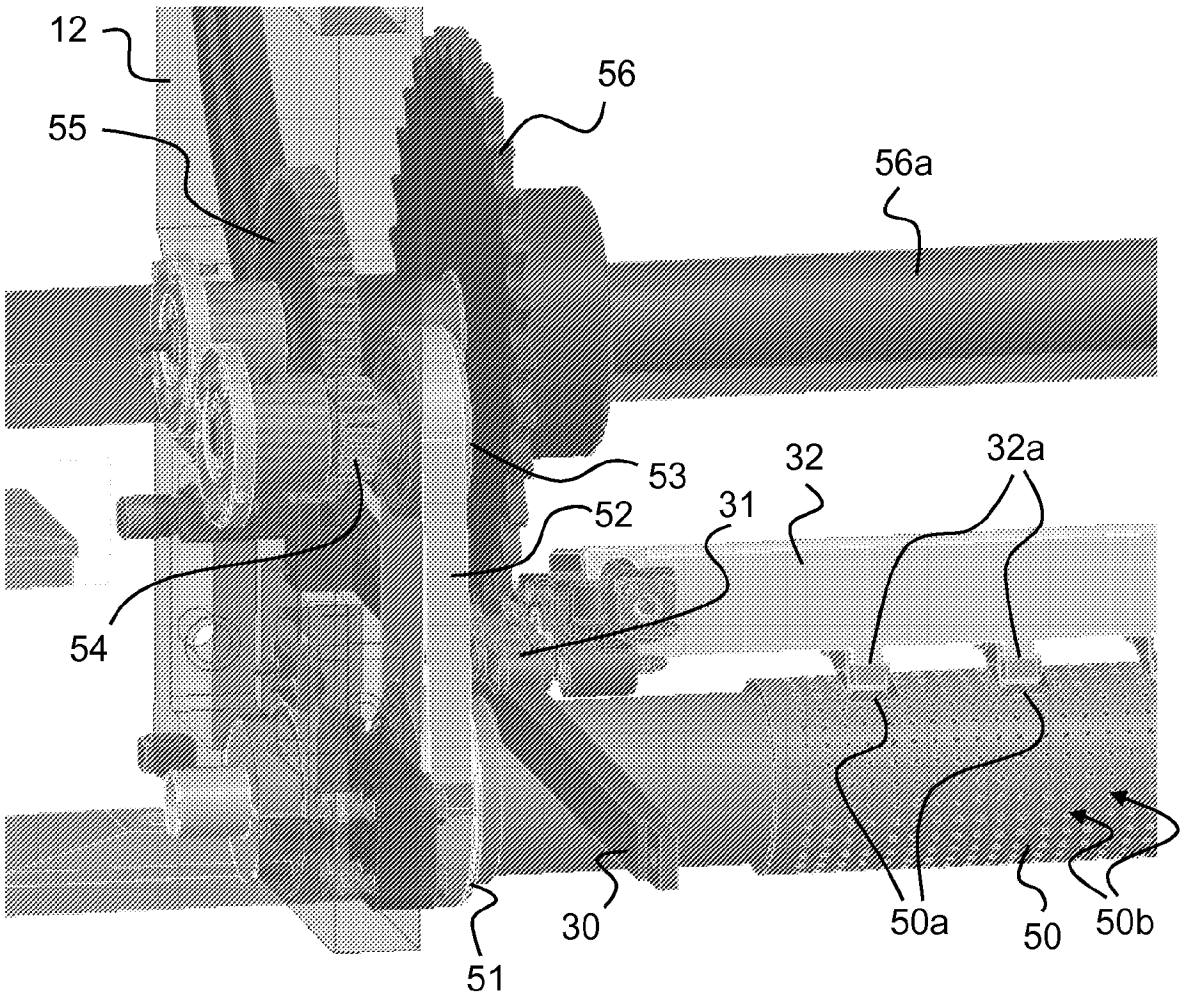
FIG. 4 is a partial perspective view of the same location of the inspection system as depicted in FIG. 3.
Figure 5:
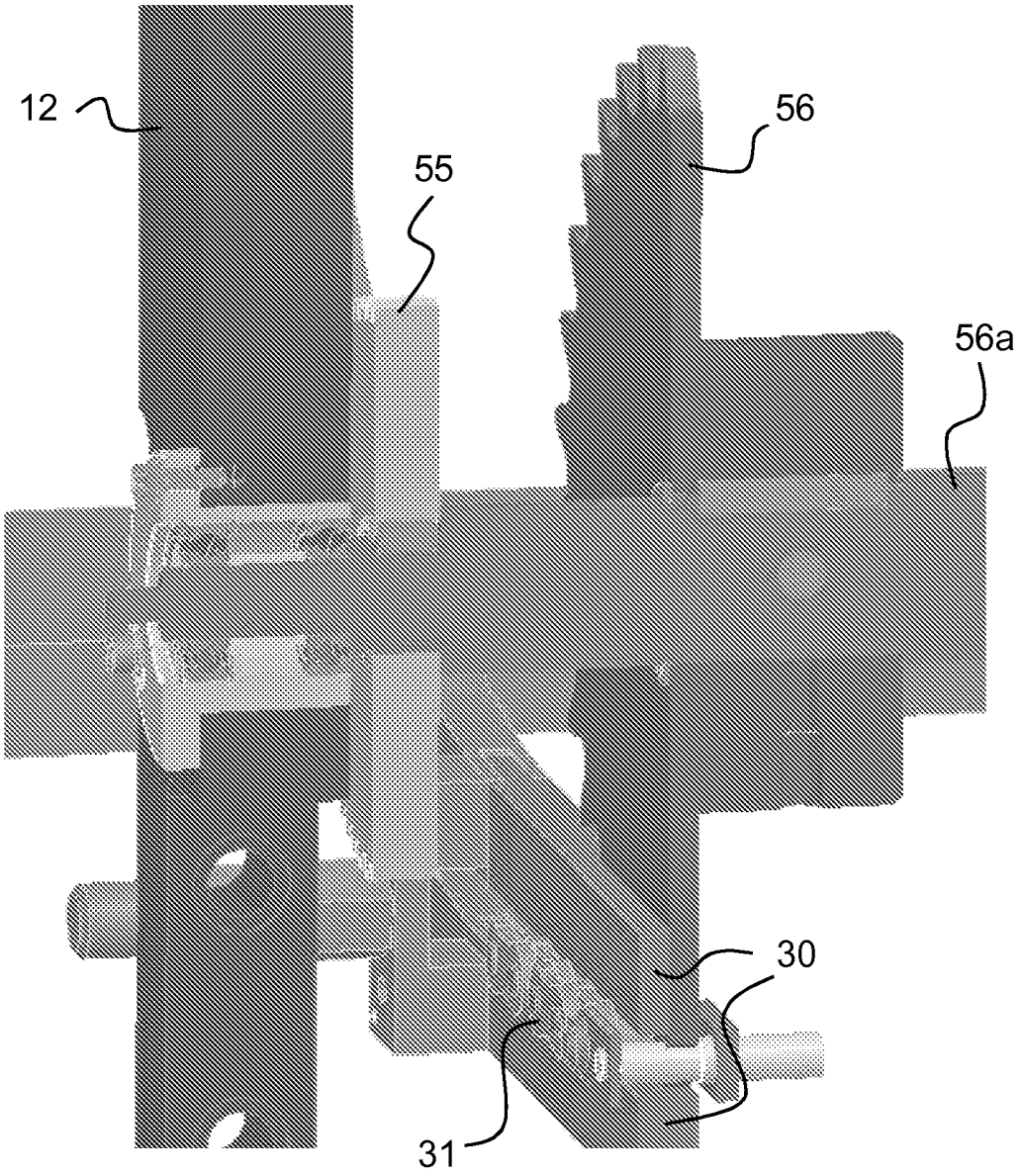
FIG. 5 is a partial perspective cut-out view showing an enlarged portion of the mechanical coupling illustrated in FIGS. 2 to 4.

FIG. 4 is a partial perspective view of the same location of the inspection system as depicted in FIG. 3 where one can again see one extremity of the single-turn shaft 56 driven by a first chain 31 of the sheet gripper system (see also FIG. 5), which single-turn shaft 56 in turn drives the suction roller 50 into rotation via the gear wheels 54, 55, pulleys 51, 53 and driving belt 52, as explained above.

The single-turn shaft 56 is designed in a similar way at its other extremity in order to be driven by the other chain of the sheet gripper system. As partly illustrated in FIG. 4, the single-turn shaft 56 comprises a shaft 56*a* that is rotatably mounted between the side frames 12 (see also FIGS. 5, 6*a* and 6*b*).

Figure 6B:
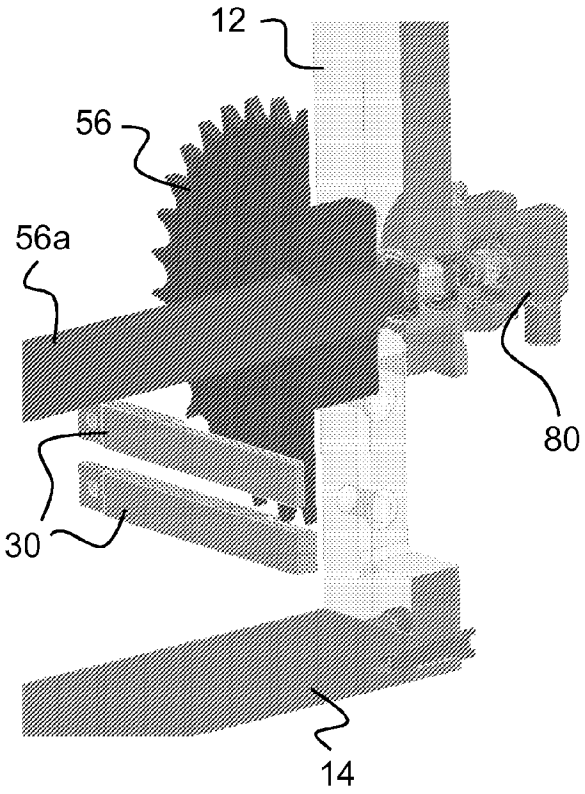
FIGS. 6*a* and 6*b* are further partial perspective cut-out views showing enlarged portions of the mechanical coupling illustrated in FIGS. 2 to 5.
Figure 6A:
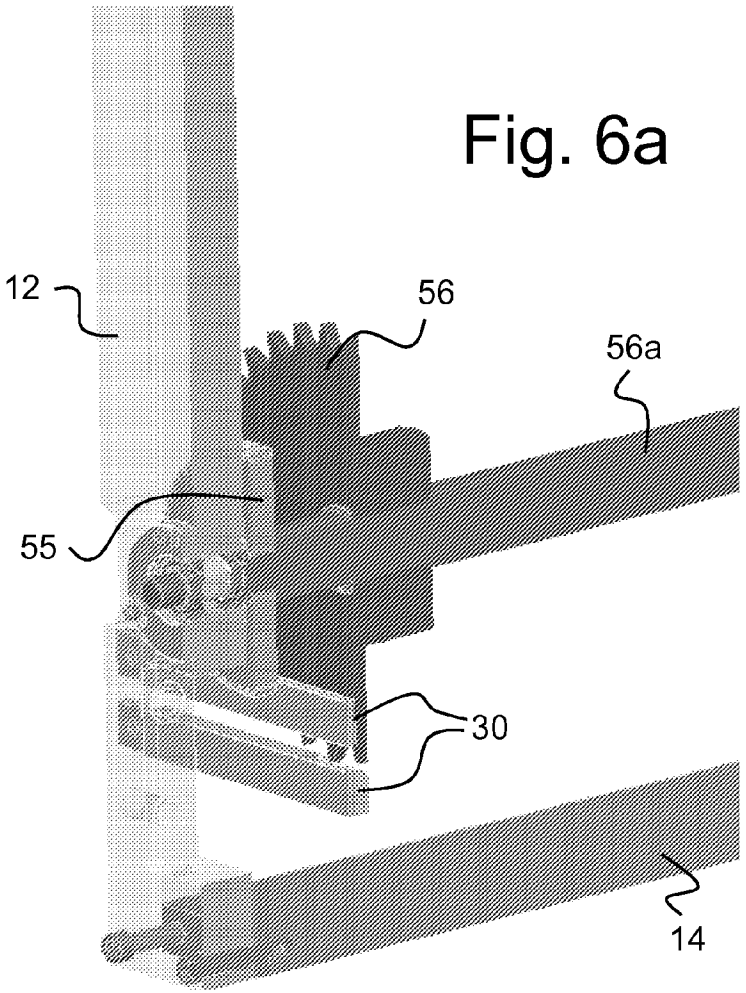

As illustrated in FIG. 6*b*, a shaft encoder 80 is advantageously provided on the extremity of the single-turn shaft 56 opposite to the mechanical coupling described above. This shaft encoder 80 can be used to synchronise operation of the optical quality control apparatus with the passage of the printed sheets.

Also visible in FIG. 4 is a gripper bar 32 of the sheet gripper system with its grippers 32*a* holding a sheet (not illustrated). The gripper bar 32 is illustrated at a time where it is located immediately above the suction roller 50.

Preferably, as illustrated in FIG. 4, the suction roller 50 is provided with a plurality of recesses 50*a* distributed along the axis of the suction roller 50 on a part of the circumference of the suction roller 50, the location of the recesses 50*a* corresponding to the location of the corresponding grippers 32*a* of the gripper bar 32. These recesses 50*a* are intended to allow the circumference of the suction roller 50 to be situated at the same level as the sheets being held by the gripper bars 32 without causing any interference between the grippers 32*a* and the surface of the suction roller 50. In the example illustrated in FIG. 4, rotation of the suction roller 50 must therefore be synchronised with the passage of the gripper bars 32.

Advantageously, a sensor (not shown) might be provided to detect rotation of the suction roller 50 and ensure that rotation thereof is properly synchronised with the passage of the gripper bar 32 so that the recesses 50*a* on the circumference of the suction roller 50 are brought in synchronism with the passage of the grippers 32*a* of the gripper bars. Such sensor can in particular be used to stop the printing press to prevent mechanical interferences between the suction roller 50 and the gripper bars 32 in case rotation of the suction roller 50 loses its synchronism or even completely stops for whatever reason.

Figure 7:
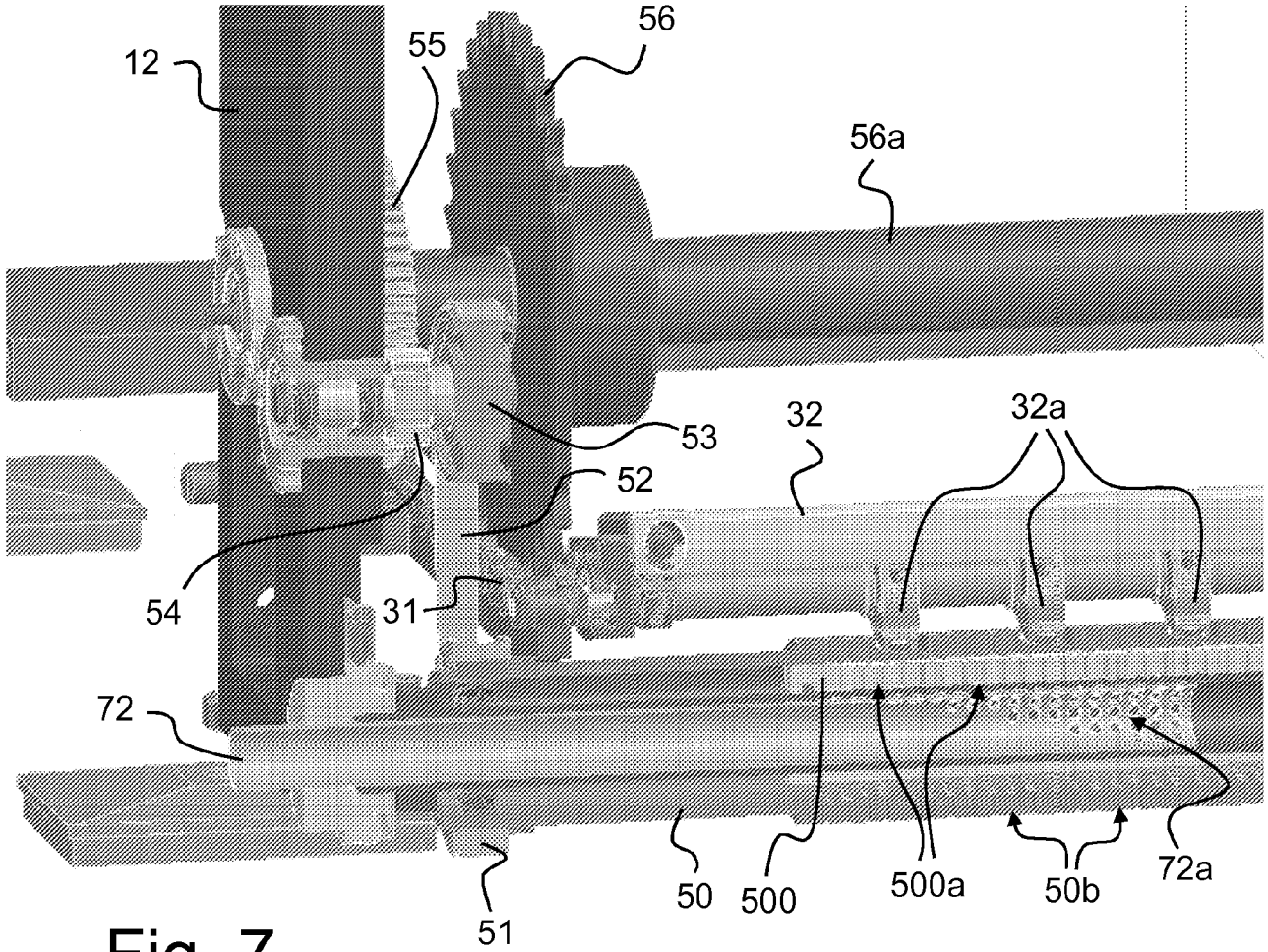
FIG. 7 is a partial perspective cut-out view of the same location of the inspection system as shown in FIG. 4, where an adjustment mechanism for controlling the suction of the suction roller is visible.

FIG. 7 is a partial perspective cut-out view, similar to FIG. 4, where a cut-out section of the suction roller 50 is visible. As illustrated in FIG. 7, the suction roller 50 is designed as a hollow cylindrical body provided with aspiration openings 50*b* on its circumference. Air is sucked through the aspiration openings 50*b* of the suction roller 50 to draw the sheet to be inspected against the circumference of the suction roller 50.

Advantageously, means are provided to selectively close part of the aspiration openings 50*b* of the suction roller 50 in dependence of the width of the printed sheets to be inspected, so as to ensure maximisation of the suction efficiency of the suction roller 50. To this end, a rotatable adjustment member 72 is located inside the suction roller 50, which adjustment member 72 is interposed between the aspiration openings 50*b* provided on the circumference of the suction roller 50 and the source of air under depression (not shown) used to suck air through the suction roller 50. This adjustment member 72 is provided with a plurality of rows of apertures 72*a* of varying numbers extending transversally to the direction of displacement of the sheets.

An intermediate member 500 is further interposed between the adjustment member 72 and the inner circumference of the suction roller 50. This intermediate member 500 does not rotate and is provided with a series of suction channels 500*a* oriented towards the upper portion of the suction roller 50 to communicate, on the one side, with part of the aspiration openings 50*b* provided on the circumference of the suction roller 50 and, on the other side, with the apertures 72*a* of the adjustment member 72.

Air is thus sucked through the aspiration openings 50*b* of the suction roller 50 only at the upper portion of the suction roller 50 which cooperates with the sheet to be inspected. Transverse rows of aspiration openings 50*b* are brought in succession to communicate with the suction channels 500*a* of the stationary intermediate member 500 as the suction roller 50 rotates.

By adjusting the rotational position of the adjustment member 72, a corresponding row of apertures 72*a* of the adjustment member 72 is selectively positioned to face the suction channels 500*a* of the intermediate member 500. Depending on the row of apertures 72*a* that is being positioned to face the suction channels 500*a*, a corresponding number of suction channels 500*a* of the intermediate member 500 can be closed, thereby closing and de-activating the corresponding part of the aspiration openings 50*b* of the suction roller 50.

Figure 8:
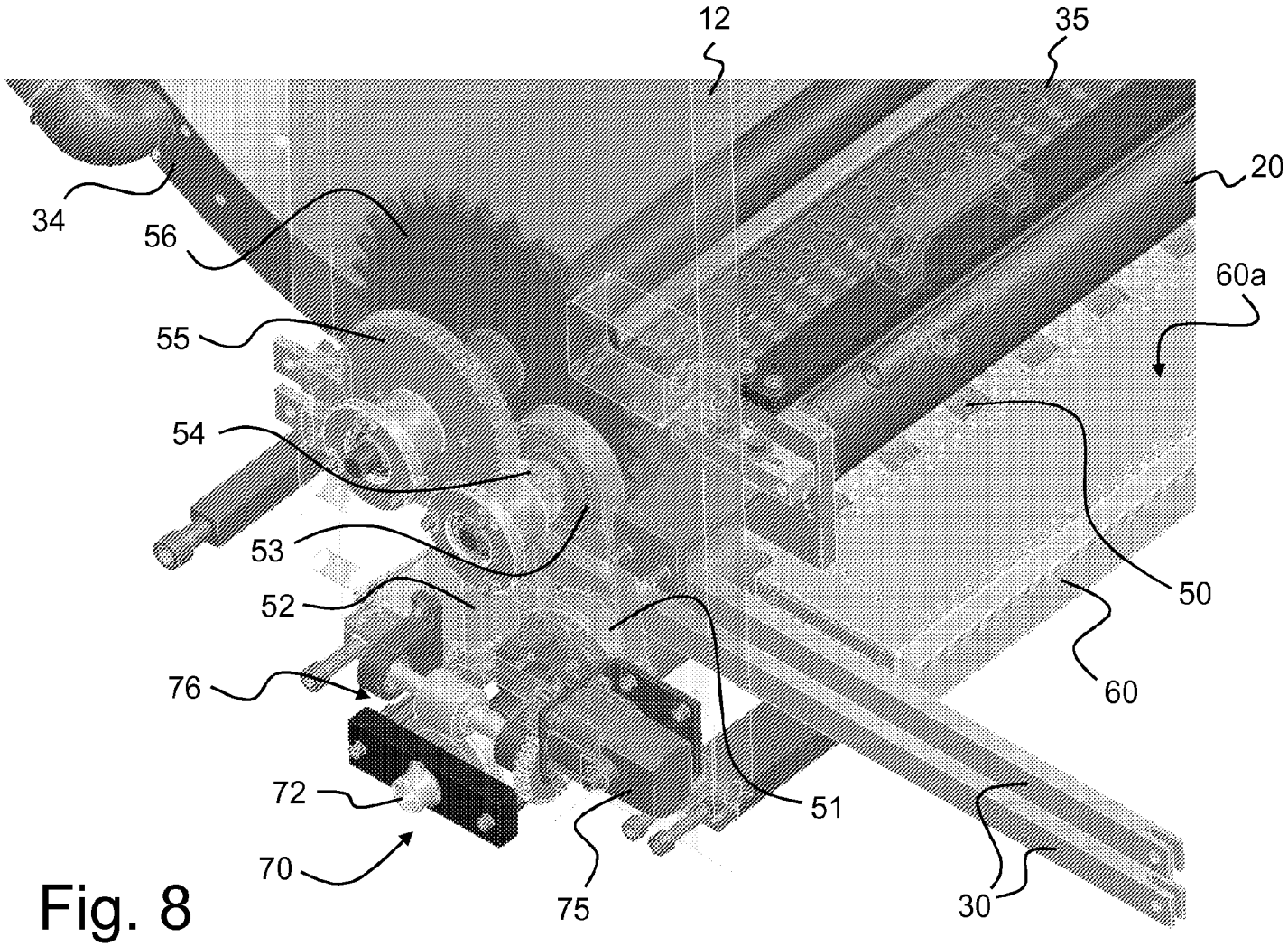
FIG. 8 is a partial perspective view illustrating further details of the adjustment mechanism of FIG. 7.
Figure 9:
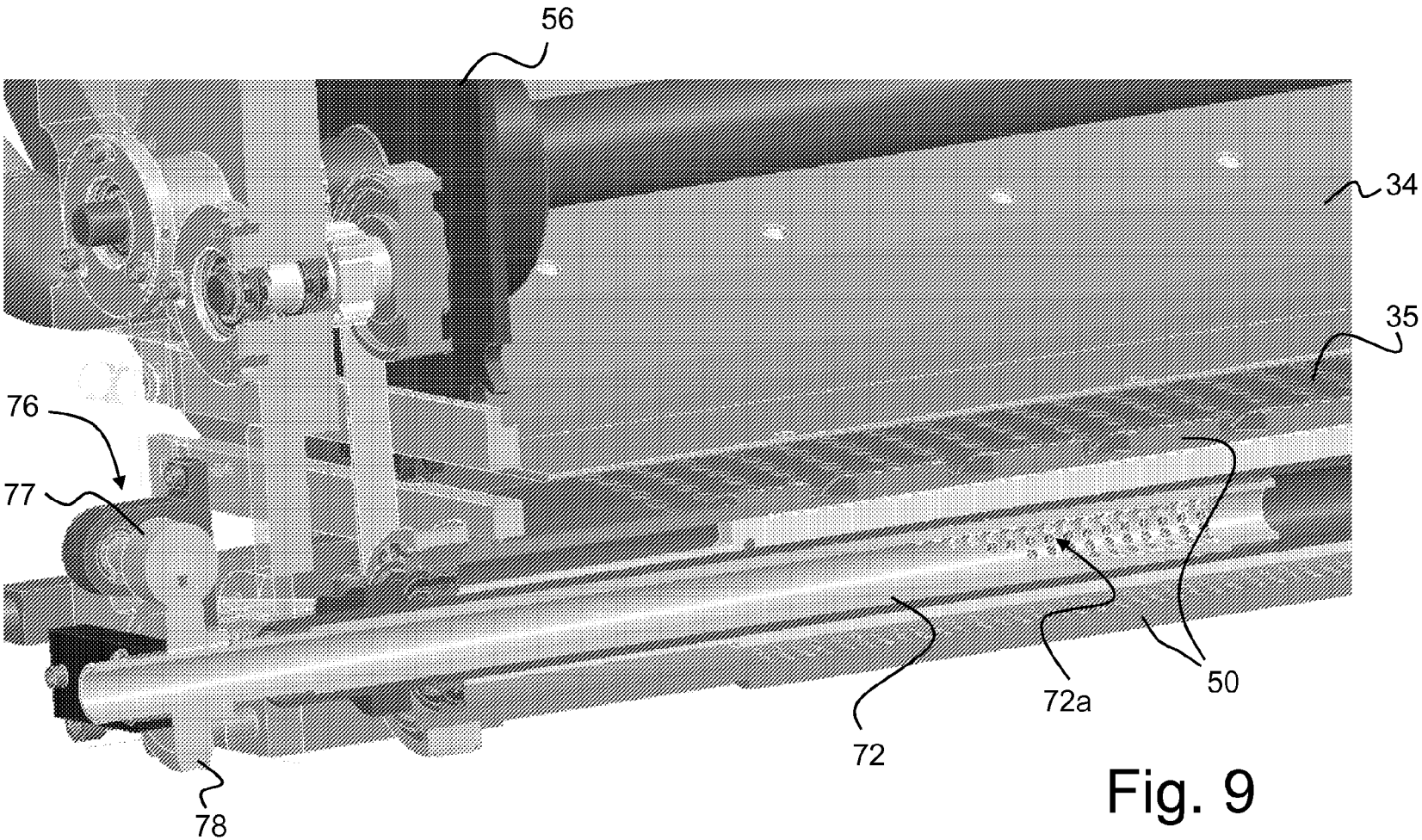
FIG. 9 is another partial perspective view of the adjustment mechanism illustrated in FIGS. 7 and 8.

FIG. 8 is a partial perspective view illustrating an adjustment mechanism 70 for changing the rotational position of the adjustment member 72. As illustrated, this adjustment mechanism 70 comprises a servo-motor 75 to control the rotational position of the adjustment member 72 via a gearing arrangement 76. Both the servo motor 75 and the gearing arrangement 76 are mounted on the side frame 12. As illustrated in FIGS. 8 and 9, the gearing arrangement 76 may comprise two helical gears 77, 78 disposed at right angles to translate the rotational movement of the output shaft of the servo motor 75 to a rotational movement of the adjustment member 72.

Figure 10A:
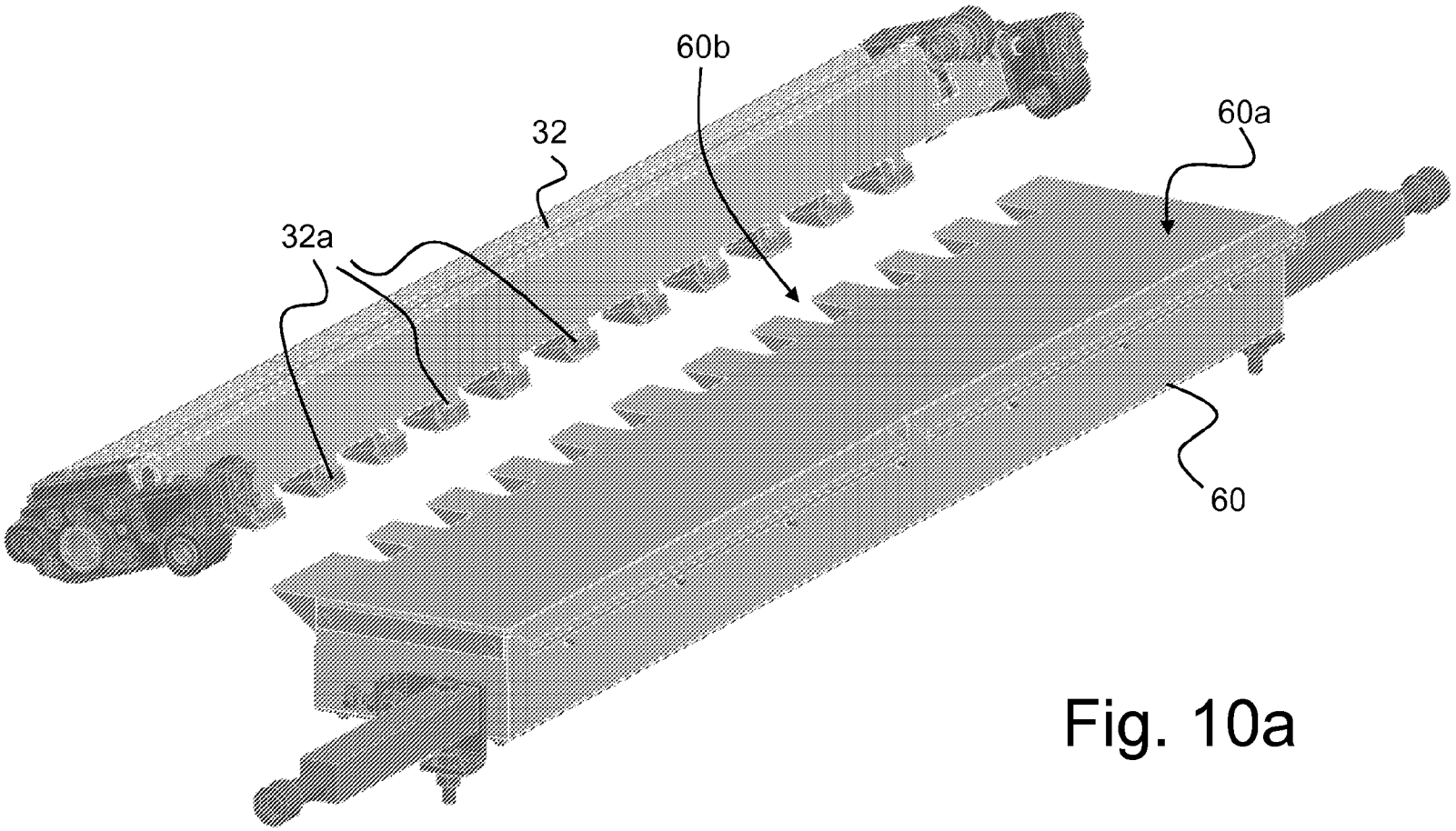
FIGS. 10*a* and 10*b* are perspective views showing the upper and lower portions of a suction box of the inspection system and of a gripper bar of the sheet gripper system.
Figure 10B:
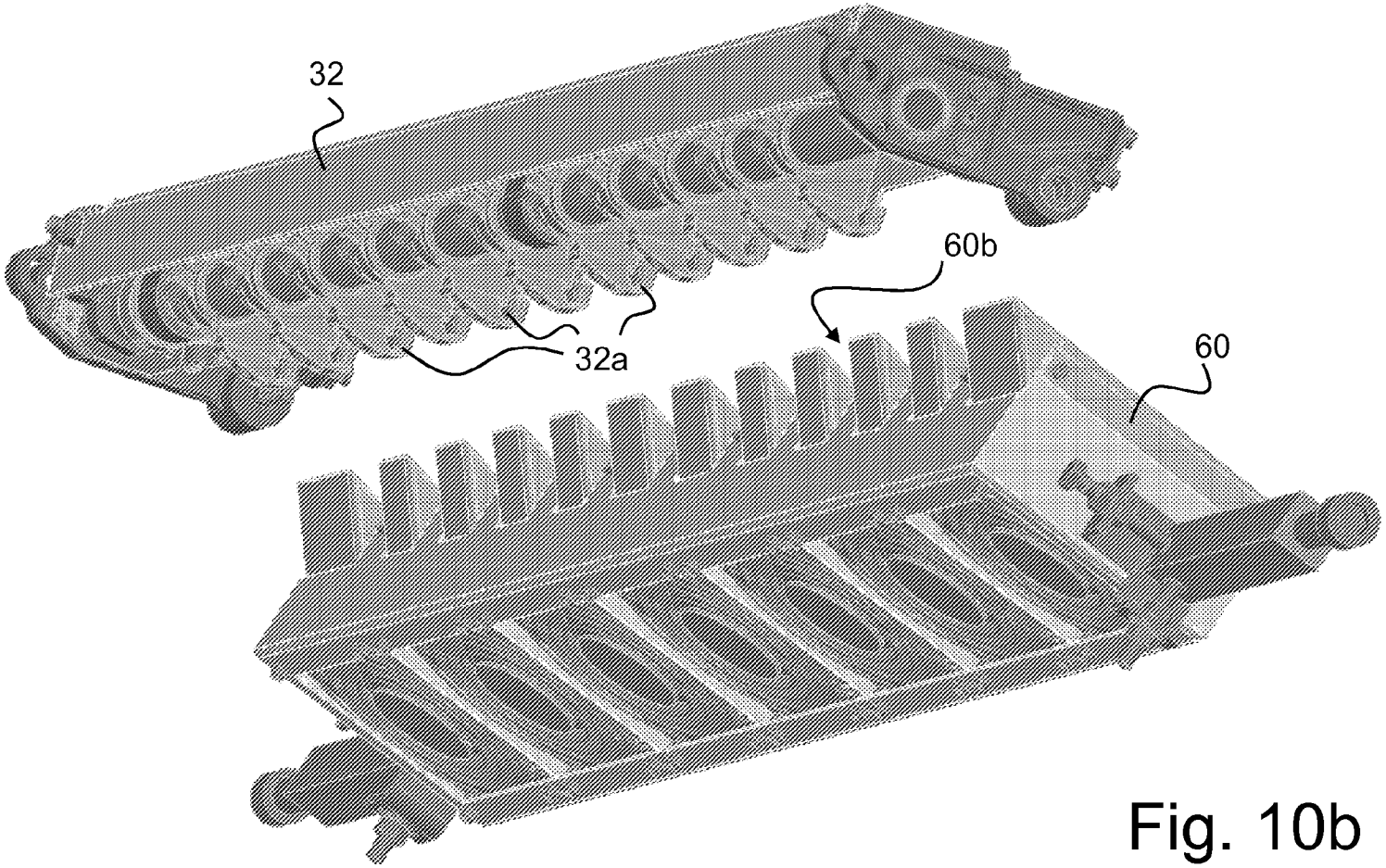

FIGS. 10*a* and 10*b* are perspective views showing the upper and lower portions of the suction box 60 (which is partly visible in FIGS. 2 and 8) of the inspection system 10 and of a gripper bar 32 of the sheet gripper system. The other components of the system have been omitted for the sake of explanation. It shall be understood that the suction box 60 is located immediately before the suction roller 50 (see again FIGS. 2 and 8) so as to cooperate with the second side of the printed sheets being transported and aspirate at least a portion of the second side of the printed sheets against a substantially flat surface 60*a* of the suction box 60 (see FIG. 10*a*) before contacting the suction roller 50. As already mentioned, the use of the suction box 60 is preferred in that it enables to properly draw the sheets to be inspected towards the downstream-located suction roller 50 and ensure that the sheets are then properly being supported against the circumference of the suction roller 50.

As illustrated in FIGS. 10*a* and 10*b*, the downstream end of the suction box 60 with respect to the direction of displacement of the sheets is provided with a number of cut-outs 60*b* corresponding in number and location to the grippers 32*a* of the gripper bar 32. In this way, the sheets can be optimally transferred to the circumference of the downstream located suction roller 50, while avoiding any interference between the grippers 32*a* of the gripper bars 32 and the downstream end of the suction box 60.

Figure 11:
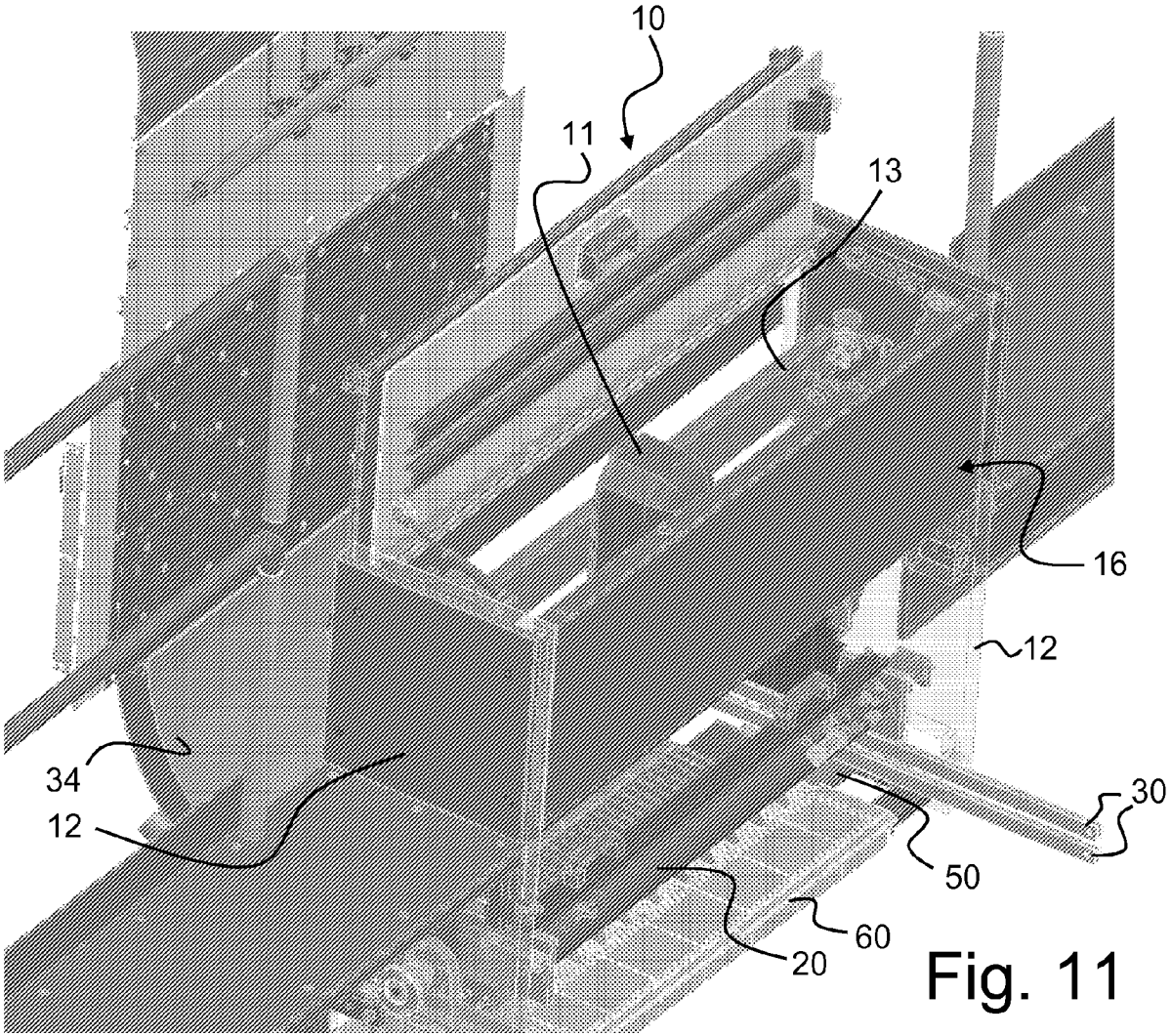
FIG. 11 is a partial perspective view of the inspection system located in a dedicated compartment of the printing press.

FIG. 11 is a partial perspective view of the inspection system 10 located in a dedicated compartment 16 of the printing press, which compartment 16 has an upper moveable cover to enable easy access to the line camera 11 for maintenance purposes.

Various modifications and/or improvements may be made to the above-described embodiments without departing from the scope of the invention as defined by the annexed claims. It shall in particular be appreciated that the invention is applicable to any type of sheet-fed printing or processing press wherein printed sheets are transported by a sheet conveyor system comprising at least one sheet gripper system including a plurality of spaced-apart gripper bars driven by chains for holding the printed sheets by a leading edge thereof.

The invention claimed is:

1. An inspection system for inspecting the quality of printed sheets which are transported by a sheet conveyor system comprising at least one sheet gripper system including a plurality of spaced-apart gripper bars for holding the printed sheets by a leading edge thereof, said inspection system comprising an optical quality control apparatus for carrying out inspection of a first side of the printed sheets while the printed sheets are being transported by the sheet gripper system, wherein said optical quality control apparatus includes a line camera for scanning the first side of the printed sheets at an inspection location which is situated at a location proximate to a portion of the sheet gripper system where the gripper bars transporting the printed sheets undergo a change of direction of displacement while the printed sheets are still being scanned by the line camera, said inspection system further comprising a suction roller that is placed in front of the optical path of the line camera along the path of the printed sheets being transported by the sheet gripper system, which suction roller contacts a second side of the printed sheets opposite to the first side which is being scanned by the line camera, said suction roller being driven at a selected circumferential speed to drive successive portions of the printed sheets being inspected by the optical quality control apparatus at a determined and controlled speed past the line camera, wherein said suction roller comprises a plurality of aspiration openings and an adjustment mechanism configured to selectively close part of the plurality of aspiration openings in dependence of the width of the printed sheets to be inspected, wherein said adjustment mechanism comprises a rotatable adjustment member provided with a plurality of rows of apertures of varying numbers extending transversally to the direction of displacement of the sheets.

2. An inspection system for inspecting the quality of printed sheets which are transported by a sheet conveyor system comprising at least one sheet gripper system including a plurality of spaced-apart gripper bars for holding the printed sheets by a leading edge thereof, said inspection system comprising an optical quality control apparatus for carrying out inspection of a first side of the printed sheets while the printed sheets are being transported by the sheet gripper system, wherein said optical quality control apparatus includes a line camera for scanning the first side of the printed sheets, said inspection system further comprising:

a suction roller that is placed in front of the optical path of the line camera along the path of the printed sheets being transported by the sheet gripper system, which suction roller contacts a second side of the printed sheets opposite to the first side which is being scanned by the line camera; and a suction box located immediately before said suction roller with respect to a direction of displacement of the printed sheets and cooperating with said second side of the printed sheets for aspirating at least a portion of the second side of the printed sheets against a substantially flat surface of the suction box before contacting the suction roller, wherein said suction roller comprises a plurality of aspiration openings and an adjustment mechanism configured to selectively close part of the plurality of aspiration openings in dependence of the width of the printed sheets to be inspected, wherein said adjustment mechanism comprises a rotatable adjustment member provided with a plurality of rows of apertures of varying numbers extending transversally to the direction of displacement of the sheets.

3. The inspection system as defined in claim 2, wherein said suction roller is driven at a selected circumferential speed to drive successive portions of the printed sheets being inspected by the optical quality control apparatus at a determined and controlled speed past the line camera.

4. The inspection system as defined in claim 1, wherein rotation of the suction roller is synchronized with the displacement of the gripper bars.

5. The inspection system as defined in claim 4, wherein a circumference of said suction roller is a fraction of the distance between two successive gripper bars.

6. The inspection system as defined in claim 4, further comprising chains driving the gripper bars and a mechanical coupling provided between the suction roller and the chains, wherein the suction roller is driven into rotation by chains driving the gripper bars through the mechanical coupling.

7. The inspection system as defined in claim 1, wherein said suction roller is driven by a separate drive.

8. The inspection system as defined in claim 1, further comprising a single-turn shaft which is driven into rotation by chains driving the gripper bars in such a way as to perform one complete revolution corresponding to the frequency of passage of successive gripper bars.

9. The inspection system as defined in claim 8, wherein a shaft encoder is provided on said single-turn shaft, which shaft encoder is used to synchronise operation of the optical quality control apparatus with the passage of the printed sheets.

10. The inspection system as defined in claim 1, wherein the sheet gripper system comprises lower and upper gripper paths along which the gripper bars are led, the printed sheets being transported by the sheet gripper system on said lower gripper path with said first side oriented upwards, and wherein said line camera is located above said lower gripper path and looks towards the first side of the printed sheets being transported on said lower gripper path.

11. A printing press comprising:

a printing unit for printing sheets;

a delivery unit;

a sheet conveyor system for transporting the printed sheets from the printing unit to the delivery unit, which sheet conveyor system comprises at least one sheet gripper system including a plurality of spaced-apart gripper bars for holding the printed sheets by a leading edge thereof; and an inspection system according to claim 1 placed along the path of said sheet gripper system.

12. The inspection system as defined in claim 2, wherein rotation of the suction roller is synchronized with the displacement of the gripper bars.

13. The inspection system as defined in claim 12, wherein a circumference of said suction roller is a fraction of the distance between two successive gripper bars.

14. The inspection system as defined in claim 12, further comprising chains driving the gripper bars and a mechanical coupling provided between the suction roller and the chains, wherein the suction roller is driven into rotation through the mechanical coupling.

15. The inspection system as defined in claim 2, wherein said suction roller is driven by a separate drive.

16. The inspection system as defined in claim 2, further comprising a single-turn shaft which is driven into rotation by chains driving the gripper bars in such a way as to perform one complete revolution corresponding to the frequency of passage of successive gripper bars.

17. The inspection system as defined in claim 16, wherein a shaft encoder is provided on said single-turn shaft, which shaft encoder is used to synchronise operation of the optical quality control apparatus with the passage of the printed sheets.

18. The inspection system as defined in claim 2, wherein the sheet gripper system comprises lower and upper gripper paths along which the gripper bars are led, the printed sheets being transported by the sheet gripper system on said lower gripper path with said first side oriented upwards, and wherein said line camera is located above said lower gripper path and looks towards the first side of the printed sheets being transported on said lower gripper path.

19. A printing press comprising:

a printing unit for printing sheets;

a delivery unit;

a sheet conveyor system for transporting the printed sheets from the printing unit to the delivery unit, which sheet conveyor system comprises at least one sheet gripper system including a plurality of spaced-apart gripper bars for holding the printed sheets by a leading edge thereof; and an inspection system according to claim 2 placed along the path of said sheet gripper system.

20. The inspection system as defined in claim 1, further comprising a suction box located immediately before said suction roller with respect to the direction of displacement of the printed sheets and cooperating with said second side of the printed sheets for aspirating at least a portion of the second side of the printed sheets against a substantially flat surface of the suction box before contacting the suction roller.

* * * * *